US005422791A

United States Patent [19]

Bentz et al.

[11] Patent Number: 5,422,791

[45] Date of Patent: Jun. 6, 1995

[54] TERMINAL STRIP FOR ELECTRIC SWITCHING DEVICE

[75] Inventors: Willy Bentz, Sachsenheim; Siegfried Goetzke, Bietigheim-Bissingen; Peter Schiefer, Abstatt, all of Germany

[73] Assignee: Robert Bosch GmbH, Stuttgart, Germany

[21] Appl. No.: 211,910

[22] PCT Filed: Nov. 27, 1992

[86] PCT No.: PCT/DE92/00991

§ 371 Date: Apr. 21, 1994

§ 102(e) Date: Apr. 21, 1994

[87] PCT Pub. No.: WO93/12562

PCT Pub. Date: Jun. 24, 1993

[30] Foreign Application Priority Data

Dec. 9, 1991 [DE] Germany ..... 41 40 487.4

[51] Int. Cl.[6] ..... H01H 35/40

[52] U.S. Cl. ..... 361/823; 200/83 R; 200/83 N

[58] Field of Search ..... 200/83 R, 83 B, 83 J, 200/83 N; 361/823; 174/52.1; 439/43–48, 52–54

[56] References Cited

U.S. PATENT DOCUMENTS 4,211,901 7/1980 Matsuda et al. ..... 200/83 B
5,101,549 4/1992 Sogge et al. ..... 29/622

FOREIGN PATENT DOCUMENTS 3437901 5/1985 Germany .

*Primary Examiner*—Bot LeDynh
*Attorney, Agent, or Firm*—Michael J. Striker

[57] ABSTRACT

In the case of a switching element, a pressure-compensation element (20) is inserted in the base body (10) of the terminal strip (11) in a recess so that a pressure compensation is possible between the interior of the housing (17) and the outer atmosphere. By means of this special arrangement of the pressure-compensation element (20) in the terminal strip (11) it is possible to test the functional capability of the pressure-compensation elements in the installed state in a simple way without additional testing processes.

7 Claims, 3 Drawing Sheets

TERMINAL STRIP FOR ELECTRIC SWITCHING DEVICE

PRIOR ART

The invention is based on a terminal strip, in particular for an electric switching device, of the generic type of the main claim. In previous terminal strips, the flat connectors which are connected to the conductor tracks of the printed circuit board of the switching device are arranged in a plurality of rows. These known plug-in connections do not have any pressure-compensation element in the base body of the terminal strip. In addition, as is disclosed for example in U.S. Pat. No. 4,800,244, the pressure-compensation elements are arranged in the wall of the housing of the control device. In order to test the pressure-compensation element for operational capability, an additional testing process is necessary in the installed state. However, for this, each control device has to be tested individually in order to ensure absolute operational reliability. Sample test-like examinations are not adequate.

ADVANTAGES OF THE INVENTION

The terminal strip according to the invention having the characterizing features of the main claim has, in contrast with the above, the advantage that the control device can be produced cost-effectively and the arrangement of the pressure-compensation element is suitable for large-scale mass production. The installation of the pressure-compensation element in the terminal strip saves space and permits simple assembly. No additional testing process is necessary since the testing of the pressure-compensation element can be carried out together with the functional testing of the terminal strip. Since every individual terminal strip has already been tested for its operational capability, the testing of the pressure-compensation element can be included in this testing process. Additional testing processes which have to be carried out separately are not necessary, neither is the testing process which is necessary for the terminal strip adversely affected. By virtue of the special design of the pressure-compensation element, a very simple installation in the terminal strip is possible. By simply applying one step, secure installation in the predetermined direction can be ensured when the pressure-compensation element is functioning in one direction only. If the pressure-compensation element is arranged inside the base body, no additional cover is needed to protect the pressure-compensation element. The base body then constitutes at the same time the protective cover.

By means of the measures specified in the subclaims, advantageous developments of the terminal strip specified in the main claim are possible.

DRAWING

Exemplary embodiments of the invention are illustrated in the drawing and explained in greater detail in the subsequent description. FIG. 1 shows a longitudinal section through a terminal strip with a pressure-compensation element installed, FIGS. 2 and 3 each show a longitudinal section through a different exemplary embodiment, FIGS. 4*a* and 4*b* show a longitudinal section through a pressure-compensation element and FIG. 5 shows a longitudinal section through a modification of a pressure-compensation element.

DESCRIPTION OF THE EXEMPLARY EMBODIMENTS

Figure 1:
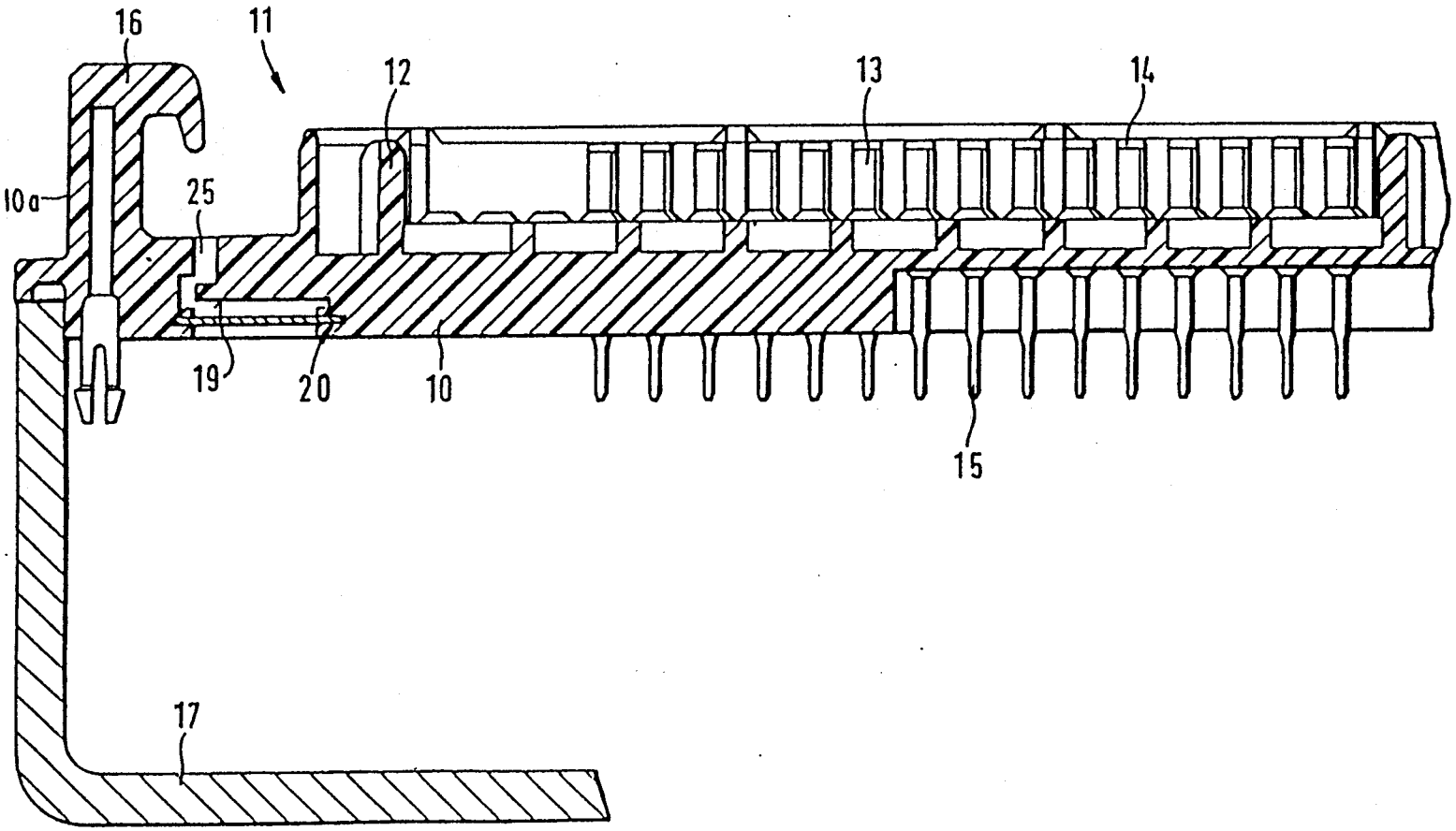

In FIG. 1, 10 designates a base body, produced from plastic, of a terminal strip 11, which body has at its front side a receptacle element 12 for receiving a mating connector (not illustrated). A plurality of flat connectors 13 are embedded in a sealed fashion in the base body 10. In this arrangement, the flat connectors 13 which are arranged in a plurality of rows project with their plug-in sections 14 into the receptacle element 12 for the mating conductor. The other end of the flat connectors 13 is constructed as a terminal lug 15 and soldered to an associated conductor track (not illustrated) of a printed circuit board.

An extension 10*a* is formed on the base body 10, on which extension 10*a* a locking part 16 is located, with which the counter bearing in the form of a snap-in closure can be attached to the terminal strip 11. At the side, facing the terminal lugs 15, of the terminal strip 11, the housing 17 of a control device is arranged. In the extension 10*a* there is a pressure-compensation element 20 in a recess 19, which pressure-compensation element 20 permits pressure compensation between the interior of the housing 17 and the surroundings of the control device. This is necessary since, when in use, the electronic components of the control device emit heat and the temperature and the pressure conditions inside the housing 17 of the control device thus change. This pressure-compensation element 20 consists of an air-permeable diaphragm 21 which is mounted in a carrier 22. In order to protect the diaphragm from splashes and, if necessary, mechanical damage, a hole constructed in a maze-like fashion 25 is present in the base body 10 of the terminal strip 11, through which hole 25 the pressure which escapes from the inside of the housing 10 through the diaphragm 21 is conducted to the outside. For this purpose, one or more holes 25 may be present in the base body.

Figure 2:
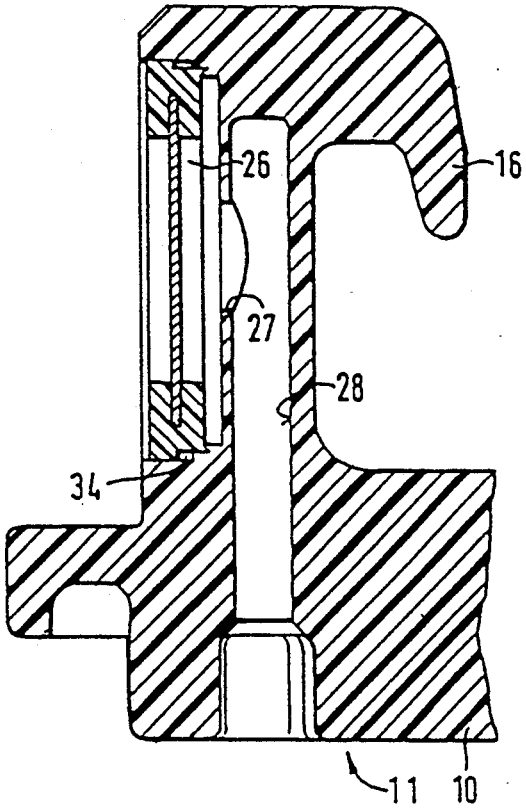
Figure 3:
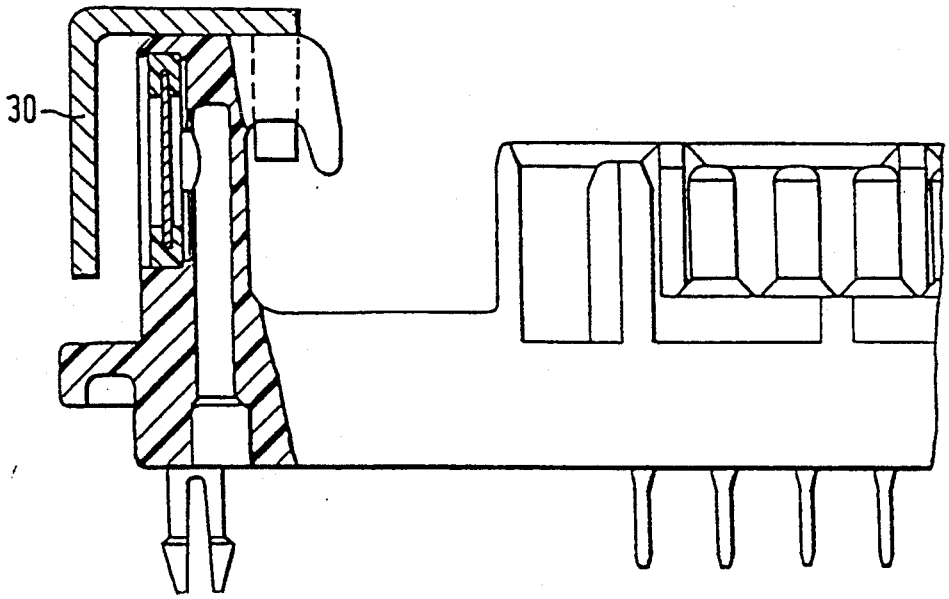

In the exemplary embodiment according to FIG. 2, the pressure-compensation element 20 is arranged in the locking part 16 of the terminal strip 11. From the space 26 which is formed above the diaphragm 21 of the pressure-compensation element 20 in the locking part 16, a hole 27 leads to a hole 28 which opens into the interior of the housing 17. With the aid of these two holes 27, 28, the space 26 above the membrane 21 is connected to the interior of the housing 17 so that a pressure compensation is possible through the diaphragm 21. In FIG. 3, in a modification according to FIG. 2 for protecting the diaphragm 21 against splashes, a cover plate 30 is fitted onto the locking part 16 of the terminal strip 11, which cover plate 30 engages over the locking part 16 at a small distance from the diaphragm 21 on the outer side of the locking part 16 over the entire length of the pressure-compensation element 20.

Figure 4A:
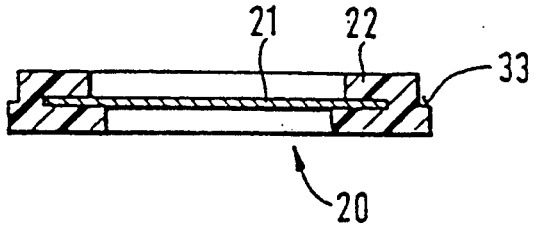
Figure 4B:
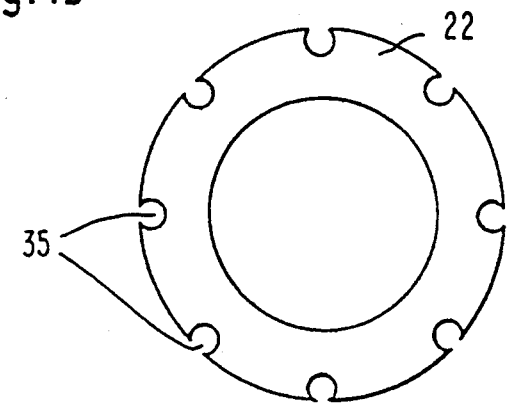

As can be seen from FIG. 4*a*, the carrier 22 of the pressure-compensation element 20 has on the outer wall a plurality of steps 33 which each correspond to a step 34 formed in the base body 10 of the terminal strip 11. These steps 33, 34 are necessary to ensure that, in the case of a diaphragm of the pressure-compensation element 20 which is only permeable in one direction, the pressure-compensation element (20) is always inserted correctly into the terminal strip 11. As can be seen from FIG. 4*b*, the steps 33 are formed in that a plurality of holes 35 are made in uniform angular spacing with respect to one another. The holes 35 intersect here the outer wall of the carrier 22 in a small region. If, on the other hand, a pressure-compensation element which is permeable in both directions is necessary, the two steps 33, 34 can be dispensed with. The insertion of the pressure-compensation element in the prescribed direction is also therefore necessary since so-called energy-direction sensors are inserted in the carrier 22 (not illustrated in the drawing), which sensors are necessary for conducting the energy during ultrasonic welding. The pressure-compensation elements 20 can be attached in the receptacle element 12 of the terminal strip in extremely different ways. Thus, they can be for example bonded in or fixed using the ultrasonic welding method.

Figure 5:
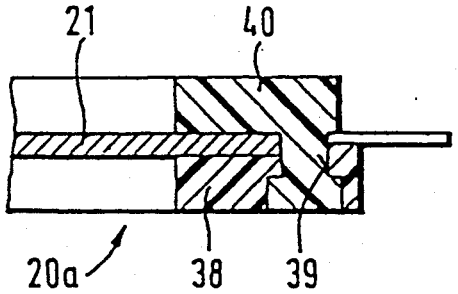

In FIG. 5, a particularly simple design is illustrated which is achieved by a rational production method for a pressure-compensation element 20*a*. Here, the diaphragm 21 is fitted onto a carrier 38. The carrier 38 has a stepped hole 39. During manufacture, the diaphragm 21 is encapsulated by injection-moulding in the region of the side facing away from the carrier 38 with a plastic material 40 and at the same time the hole 39 is filled with this plastic material by injection-moulding. By virtue of the stepped hole 39, the plastic material 40 becomes wedged so that a secure and strong bond between the carrier 38 and the plastic material 40 is produced and the diaphragm 21 is thus arranged securely and immovably.

We claim:

1. A pressure compensating element, comprising a body; and a diaphragm, said body including a carrier provided with a plurality of stopped holes and a plastic mass which engages in said holes and also at least partially covers said diaphragm at an edge region of said diaphragm which rests on said carrier.

2. A terminal strip, in particular for an electric switching device, comprising a base member; a pressure compensating element including a body, and a diaphragm, said body including a carrier provided with a plurality of stopped holes and a plastic mass which engages in said holes and also at least partially covers said diaphragm at an edge region of said diaphragm which rests on said carrier; and a plurality of plug-in connecting components provided in said base member and leading in a sealed fashion out of said base member so as to be connected to electrical components.

3. A terminal strip as defined in claim 2, wherein said base member has an inner wall provided with a recess, said pressure compensating element being arranged in said recess.

4. A terminal strip as defined in claim 2, wherein said pressure compensating element is arranged in an outside of said base member.

5. A terminal strip as defined in claim 2; and further comprising a locking part having a recess, in which said pressure-compensating element is arranged; and a housing having an interior connected with a space in front of said pressure compensating element.

6. A terminal strip as defined in claim 5; and further comprising a protective shutter arranged in front of said pressure-compensating element.

7. A terminal strip as defined in claim 2, wherein said base member has at least one maze-like hole formed in front of said pressure compensating element.

* * * * *